US005534678A

United States Patent [19]

Bowles et al.

[11] Patent Number: 5,534,678

[45] Date of Patent: Jul. 9, 1996

[54] OVEN WITH IMPROVED SELF-CLEANING CYCLE

[75] Inventors: Patrick J. Bowles; Stephen M. Bakanowski; Michael T. Beverle; Robert V. Chou; John C. Reiche, all of Louisville, Ky.; Nayson N. Khoshnood, Chattanooga, Tenn.

[73] Assignee: General Electric Company, Louisville, Ky.

[21] Appl. No.: 151,539

[22] Filed: Nov. 12, 1993

[51] Int. Cl.[6] ..... A21B 1/02

[52] U.S. Cl. ..... 219/396; 219/398

[58] Field of Search ..... 219/391, 393, 219/395, 396, 397, 398, 412, 413, 483, 484, 486

[56] References Cited

U.S. PATENT DOCUMENTS

| | | | |
|---|---|---|---|
| 3,092,706 | 6/1963 | Chisolm | 219/486 |
| 4,238,670 | 12/1980 | Maitenaz | 219/413 |
| 4,493,976 | 1/1985 | Wilson | 219/398 |
| 4,831,237 | 5/1989 | Gelineau | 219/398 |
| 5,280,157 | 1/1994 | Hornung | 219/397 |
| 5,396,047 | 2/1995 | Schilling | 219/449 |

FOREIGN PATENT DOCUMENTS

| | | | |
|---|---|---|---|
| 2284243 | 9/1974 | France | 219/398 |

*Primary Examiner*—Teresa J. Walberg
*Assistant Examiner*—J. Pelham
*Attorney, Agent, or Firm*—H. Neil Houser

[57] ABSTRACT

A pyrolytically cleaned oven includes an upper broil element and a lower bake element, the broil element is energized until the oven temperature reaches a trigger temperature, well below the glass transition temperature point of the oven porcelain enamel; then the bake and broil elements are alternately energized in a cyclical manner until an off temperature, somewhat above the trigger temperature but still below the transition temperature, is reached. Thereafter one or both of the elements are cycled to maintain the temperature with a range between the off temperature and a lower on temperature, also within the effective self cleaning range.

30 Claims, 9 Drawing Sheets

OVEN WITH IMPROVED SELF-CLEANING CYCLE

BACKGROUND OF THE INVENTION

Self-cleaning (that is pyrolytically cleaned) ovens incorporate several features, including:

- Initial application of high heat at the top of the oven chamber to initiate operation of the catalytic smoke eliminator before heavy soils on the side and bottom walls are volatized.
- Continued supply of heat to maintain at least a minimum required temperature in the oven for pyrolysis of the soils over a period of time.
- Control of the heat to prevent the temperature from exceeding the operating or softening temperature of the enamel on the oven walls while maintaining the temperature of all parts of the oven walls within the effective self-clean range.

Manufacturers have used a number of different techniques to control the self-cleaning cycle. Typically, however, oven controls begin the cycle with full power (i.e. 240 v, 208 v, 120 v etc.) applied to the broil (upper) heating unit for a fixed amount of time. At some point during the cycle some controls switch to the bake unit as the primary source of heat input, while others use the bake unit to augment the broil unit input. This may be done at full power or at reduced power (i.e. 120 v etc.). Some other manufacturers use a fixed setting cycle switch, such as a bimetal switch for example, to reduce the effective power of the heating units. Other controls use one unit, either the bake or the broil, exclusively for the heat input. In all ovens known to the applicants, however, a thermostat is used to call for heat when needed to satisfy the minimum requirements and to stop heat input to keep the oven liner temperature from exceeding maximum design temperature.

In order to satisfy the requirements of the various normal cooking modes, the broil and bake units normally are high wattage elements. As a result localized temperatures adjacent the elements are significantly higher than the general level of the temperature in the oven. In a self-cleaning cycle this can cause the temperature of the enamel adjacent the heating element to exceed the operating range of the porcelain enamel. If the localized temperature approaches the glass transition temperature of the enamel/steel composite, the enamel may craze, crack or peel.

On the other hand, some portions of a typical oven liner generally have lower temperatures than the temperature prevalent in most of the chamber. For example, in ovens with a drop down access door, the area adjacent the lower edge of the door often has lower temperatures. When prior art controls keep the maximum temperatures within the desired range, such lower temperature liner areas often drop below the self-clean range and their cleaning is not fully satisfactory.

In order to balance the need to provide as short self-cleaning cycles as practical and the need to stay below the degradation temperature of the oven walls, the self-cleaning cycle should be conducted within a rather narrow temperature band. For example an optimal cleaning operation would result from maintaining all portions of the cooking chamber walls at a constant 880° F. for about three hours. Reasonable balanced results can be obtained by operating between 800° F. and 950° F. However, in order to maintain the overall oven wall temperatures in this range, prior art controls often resulted in localized enamel temperatures outside the range and high enough to adversely affect the enamel, particularly near the broil element and the lower wall under the bake element.

It is an object of this invention to provide an improved self-cleaning oven in which the enamel covering of the liner is not adversely affected by the cleaning operation.

It is another object of this invention to provide such an improved oven in which localized temperatures of portions of the liner do not become deleterious to the enamel and yet effectively clean the entire oven liner.

It is yet another object of this invention to provide such an improved oven in which the designated heating units are energized in a cyclical fashion to moderate the localized temperatures.

It is still another object of this invention to provide such an improved self-cleaning oven without the need for additional hardware devices.

SUMMARY OF THE INVENTION

In accordance with one embodiment of the invention a pyrolytically cleaned cooking oven includes a liner forming a cooking chamber with a broil element at its top and a bake element at its bottom. A catalytic smoke eliminator has its entrance at or near the top of the chamber. A temperature sensor is positioned to sense the temperature in the chamber. A control to provide a self-cleaning cycle is connected to each heating element and to the temperature sensor. The control is effective to continuously energize the broil element until the sensor senses a trigger temperature. The control then is effective to cyclically energize at least one of the heating elements with a predetermined duty cycle until the sensor senses a higher predetermined off temperature. Thereafter the control is effective to deenergize both of the heating elements from each time the sensor senses the off temperature until it next senses a lower predetermined on temperature and to cyclically energize at least one of the heating elements with a predetermined duty cycle from each time the sensor senses the on temperature until it next senses the off temperature.

BRIEF DESCRIPTION OF THE DRAWINGS

While the novel features of the invention are set forth with particularity in the appended claims; the invention, both as to organization and content, will be better understood and appreciated from the following detailed description, taken in conjunction with the drawings, in which:

DETAILED DESCRIPTION OF PREFERRED EMBODIMENT

Figure 1:
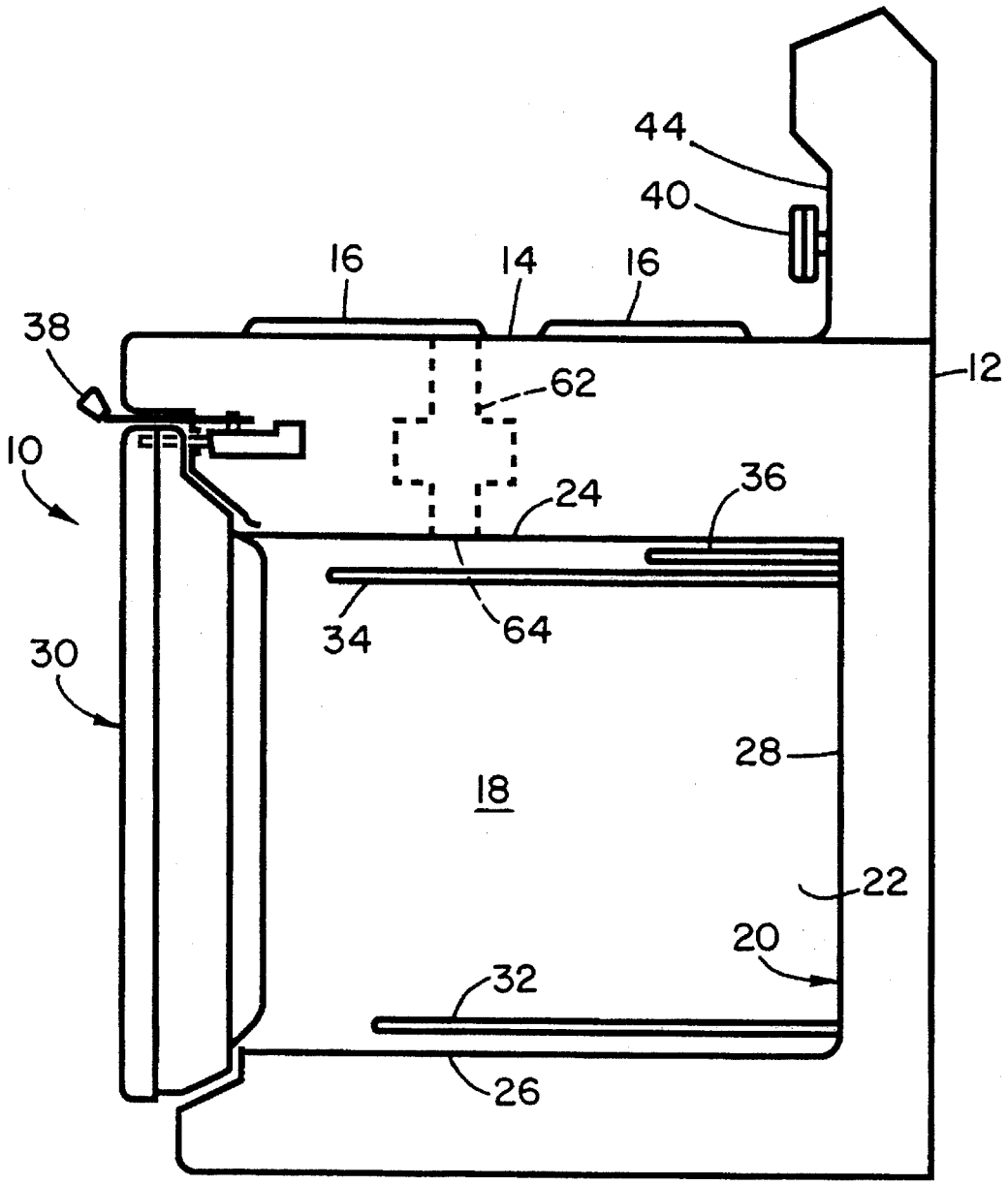
FIG. 1 is a fragmentary side elevation view of an electric self-cleaning range incorporating a illustrative embodiment of the present invention.

Referring now to the drawings, and more particularly to FIG. 1, there is shown an illustrative free standing electric range 10. While a free standing electric range is used to illustrate the invention it will be understood that the invention is equally applicable to other oven products as well. The range 10 includes an outer cabinet 12 with a top cooking surface 14 having a plurality of individual surface units 16. Positioned within the cabinet 12 is a cooking chamber or cavity 18 formed by a box-like oven liner 20 having vertical side walls 22, top wall 24, bottom wall 26, rear wall 28 and a front opening drop door 30. The cooking chamber is provided with two heating units or electric resistance heating elements; that is a bake element 32 positioned adjacent the bottom wall 26 and a broil element 34 positioned adjacent the top wall 24. A standard temperature probe or sensor 36 is mounted to project into the cooking chamber 18 and senses the temperature within the chamber. A door latch handle 38 is used for locking the door 30 in its closed position during self-cleaning operations. A control knob 40 extends outwardly from the control panel 42 (FIG. 2), which is supported from the back splash 44 of the range 10. A catalytic smoke eliminator is schematically illustrated at 62 and has its entrance or inlet conduit 64 communicating with the chamber 18 through liner top wall 24. Thus broil element 34 is adjacent the entrance 64.

Figure 2:
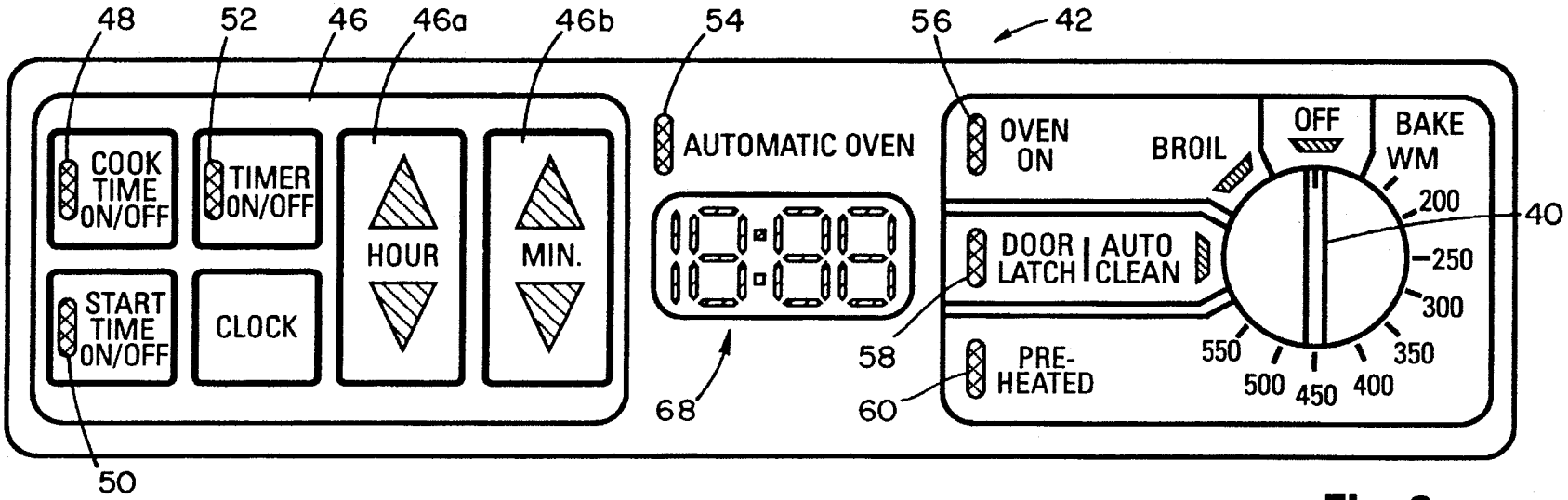
FIG. 2 is an enlarged plan view of the control panel of the range of FIG. 1.

As shown in FIG. 2, the control panel 42 also includes an array of touch pads 46, indicator lamps 48–60 and an electronic time display 68, all as is well known in the art. The control knob 40 enables an user to select operation in any of the bake, broil and pyrolytic or self-clean modes of operation simply by rotating the knob 40 to the corresponding position identified by the indicia surrounding the knob.

Figure 3:
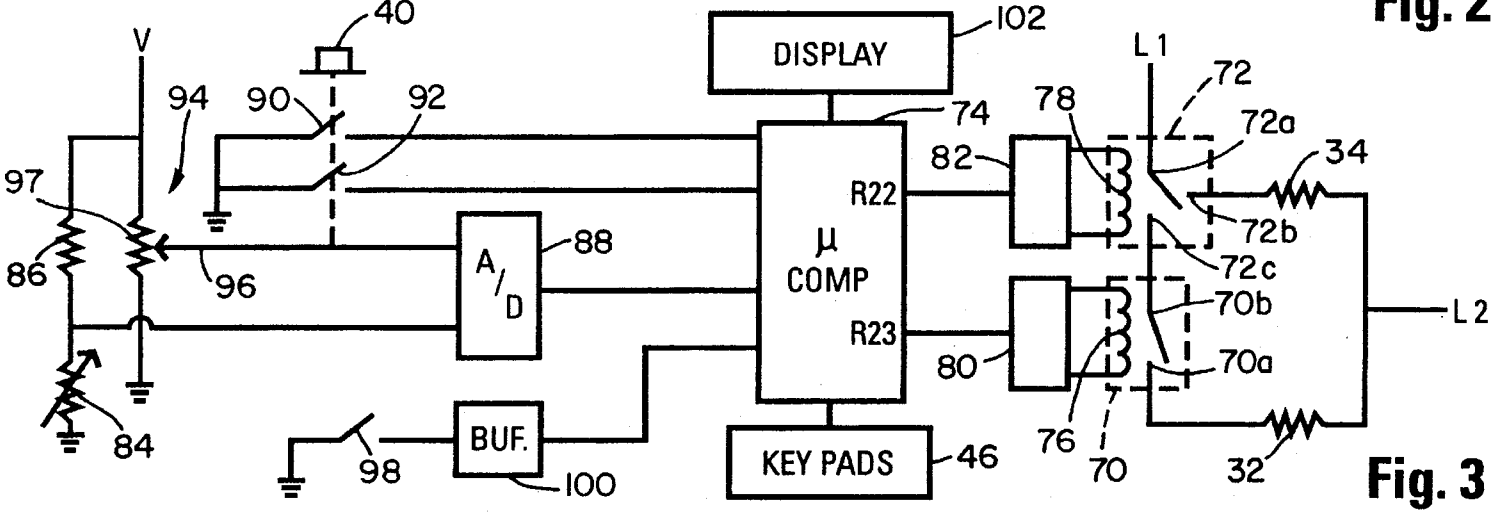
FIG. 3 is a simplified schematic circuit diagram for the control circuit of the range of FIG. 1.

A simplified circuit diagram for the control of the illustrative embodiments of the invention is shown in FIG. 3. Power to the bake and broil units respectively is provided by application of a standard 60 Hz AC power signal of nominal 240 volts across L1 and L2. The bake element 32 and the broil element 34 are controllably energized by selective connection across L1, L2 via the switching contacts of the bake and broil relays, 70, 72 respectively. One side of the broil 34 element is connected to power supply line L2 and the other side is connected to L1 via relay contacts 72*a* and 72*b* of broil relay 72. Similarly, one side of the bake element 32 is connected to L2 and the other side is connected to L1 via relay contacts 70*a* and 70*b* of the bake relay 70 and contacts 72*a* and 72*c* of the broil relay 72. The relay contacts are interconnected in this fashion to preclude simultaneous energization of both the bake element 32 and the broil element 34.

A microprocessor 74 controls the switching of the relays 70, 72 by trigger signals which are coupled to relay coils 76, 78 via conventional driver circuits 80, 82 respectively. Oven temperature inputs are provided to the microprocessor 74 via temperature sensing means comprising a conventional temperature sensor 84, which conveniently is contained in the probe 36 in cooking chamber 18. The sensor 84 is connected in series with a precision resistor 86, forming a voltage divider network energized by a regulated low voltage dc power supply. The junction of the sensor 84 and the resistor 86 is coupled to the microprocessor 74 via a conventional analog to digital(A/D) circuit 88.

As briefly described in connection with FIG. 2, user rotation of control knob 40 to the corresponding position inputs the bake, broil and self cleaning selection to microprocessor 74. As illustrated schematically in FIG. 3, the shaft of knob 40 is operatively connected to switches 90, 92, such that switch 90 is closed by rotation to of knob 40 to the BROIL position, switch 92 is closed by rotation of knob to the AUTO CLEAN position. Each of the switches 90, 92 is serially connected between a corresponding input port of the microprocessor 74 and ground. The knob 40 also is connected to the wiper arm 96 of a potentiometer 94. When the knob is in any but its BAKE range, the arm is not in contact with the resistor 97 of potentiometer 94. When knob 40 is moved anywhere in its BAKE range, the arm 96 engages resistor 97 and the exact point of engagement is determined by the particular temperature selected by the position of knob 40. Input potentiometer 94 is coupled between the regulated dc voltage power supply and ground while the associated wiper arm 96 is coupled to A/D circuit 88. The voltage between the wiper arm and ground is an analog signal representing the selected temperature for operation in the bake mode. A/D circuit 88 converts the analog signal from temperature sensor 84, representing the sensed oven temperature, and the analog signal representing the selected oven temperature from wiper arm 96 to digital values which are input to the microprocessor 74. Thus the microprocessor detects selection of the broil, bake or self-clean mode by the change in the state of the switches.

Door latch switch 98 is a mechanically actuated switch which is closed by movement of the latch handle 38 (FIG. 1) to its latched position. One terminal of the door latch switch 98 is connected to ground, and the other is coupled to an input port of microprocessor 74 via the conventional buffer circuit 100. The microprocessor 74 monitors the state of door latch switch 98 to determine the state of the door latch.

User inputs are also provided to the microprocessor by actuation of the key pads 46. The display designated 102 represents the digital time display 68 and the array of LED indicator lamps 48–60 of FIG. 2.

In the illustrative embodiment, the microprocessor 74 is a chip designated HD614149PA89, commercially available from Hitachi.

To initiate operation of the oven in the pyrolytic or self-clean mode, the user rotates control knob 40 to the position labeled "AUTO CLEAN" in FIG. 2 and moves the latch 38 to its latched position. The microprocessor then establishes a total self-clean time. This time includes an active portion during which at least one of the heating elements 32, 34 will be energized, either continuously or with a predetermined duty cycle, as will be explained in more detail hereinafter, to obtain and maintain an elevated pyrolytic cleaning temperature within the cooking chamber 18. The time also includes a passive cool down portion during which the elements 32, 34 are de-energized and the oven chamber 18 cools to a temperature appropriate for the user to open the door 30.

The illustrative oven control arrangement enables the user to adjust the duration of the self-clean operating mode or cycle to match the degree of soil present on the walls of the liner 20. In the exemplification, the total clean time can be varied between a minimum of 3 hours and a maximum of 5 hours and 59 minutes. The user can increase or decrease the set time by actuating one of the hour and minute slew pads 46*a* and 46*b* (FIG. 2) respectively, during the first minute of operation in the self-cleaning mode. Such changes are permitted until one minute has elapsed after the last slew key actuation. Within this one minute window, the value of the clean time is increased or decreased depending on whether the up or the down slew pad is actuated.

The microprocessor 74 is customized to perform the control functions in accordance with this invention by permanently configuring the read only memory (ROM) of the microprocessor 74 to implement predetermined control instructions. FIGS. 4–7 and FIGS. 4, 5, and 7–9 respectively are flow diagrams which illustrate self-clean control routines incorporating control programs of the microprocessor 74 for two separate illustrative embodiments of the present invention. Two separate programs are described hereafter in some detail for purposes of illustration; however, it will be understood that normally only one self-clean control program would be configured into the ROM of the microprocessor 74 for a particular oven. From these diagrams one of ordinary skill in the art can prepare a set of control instructions for permanent storage in the ROM of the microprocessor 74. For the sake of simplicity and brevity the control routines will be described only as to implementation of the control algorithms relating to the self-clean mode or cycle. It should be understood that there may be other control functions relative to other operations of the appliance to be performed in conjunction with other operating characteristics of the appliance. Instructions for carrying out the routines described in the diagrams may be interleaved with instructions and routines for the other control functions which are not part of the present invention.

It will be understood that only a few microseconds are needed for the microprocessor to execute the entire self-clean routine of FIGS. 4–7 or of FIGS. 4, 5, 7–9. When the routine calls for a particular component to assume a designated condition, that component will remain in that condition until the microprocessor calls for it to change its condition. For example, when "SET" a flag will remain SET until ordered to be "RESET". It also will be understood that normally a device or operation is operative when "SET" and is inoperative when "RESET" and that "resetting" a timer places it to its initial condition. Also the speed of the microprocessor is so fast in comparison to the speed at which conditions within the oven change that the control effectively instantaneously responds to then existing oven conditions, even though the microprocessor only checks a condition once each pass through the self-clean routine.

In accordance with an important aspect of the present invention the heating element adjacent the smoke eliminator entrance is initially energized continuously to raise the temperature of the smoke eliminator to its operational temperature before degradation of soil on the liner generates an appreciable amount of smoke or other fumes. Then at least one of the elements is energized in a cyclical on/off duty cycle during the self-clean operation. This effectively reduces the apparent wattage of the element, and its sheath temperature. This reduces the differential between the localized heating of the portion of the liner wall adjacent a heating element and the more general heating of the overall liner. Thus areas of local hot spots are normalized and the liner is not operated at a temperature sufficiently high to significantly degrade the enamel coating on the liner. At the same time sufficient heat is added to the oven to assure that the liner remains in the self-clean temperature range.

"Duty cycle" or "duty cycling" refers to a fairly rapid on/off operation within a longer period of operation. As used herein duty cycle encompasses both the on/off operation of a single designated element and the on/off operation of both elements in a complimentary or reciprocal manner so that there is alternate operation or energization of the heating elements when both the bake and broil elements are designated.

Figure 10:
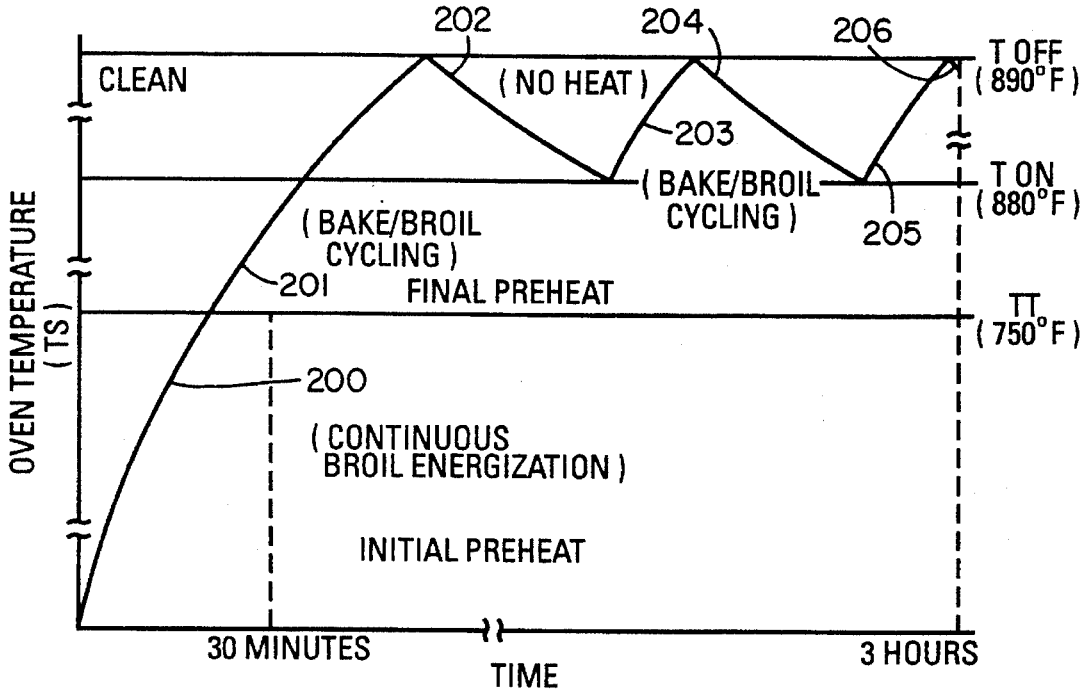
FIG. 10 is a schematic chart illustrating the temperature of the oven plotted against time in accordance with the self-clean routine illustrated in FIGS. 4–7.

In accordance with a first self cleaning operation, utilizing the routine illustrated in FIGS. 4–7, the control cycles the bake and broil elements 32, 34 in an alternative manner to maintain the pyrolytic cleaning temperature. The self cleaning operation of the oven is generally illustrated in FIG. 10. It will be understood that FIG. 10 is a schematic representation generally illustrating the operation incorporated into the routine of FIGS. 4–7 and that the temperature lines do not necessarily represent temperature measurements made in a particular oven during a self-cleaning operation.

Referring now to FIG. 10, during an initial preheat stage, the broil element 34 is continuously energized, as indicated by line 200, to initially raise the temperature within the oven, particularly at the top of the cooking chamber, so that the smoke eliminator 62 will reach its operating temperature range before generation of any appreciable amount of smoke or fumes by pyrolysis of soil on the liner walls. At a predetermined "trigger" temperature (TT), for example 750° F. in the illustration, the smoke eliminator is operative but the chamber has not reached a steady state condition and any localized heating associated with continuous operation of the broil unit has not caused the adjacent portions of the enamel to reach a critical temperature at which it would be adversely affected, for example 950° F.

When the sensor 84 senses that the general temperature in the chamber 18 is 750° F., final preheat begins and the control switches to a mode of operation in which the bake element and the broil element are alternately energized in a predetermined duty cycle for the final preheat operation, as illustrated by line 201. For example, the bake element is energized for 75 seconds and the broil element is energized for 25 seconds. This cyclical operation continues until the sensor 84 senses that the cooking chamber 18 has reached the upper limit of the desired self-cleaning temperature range, for example 890° F. in the illustration, referred to as the "off" temperature (T OFF).

At this time the control de-energizes both of elements 32 and 34, as indicated by line 202. The temperature in the chamber then slowly falls until the sensor 84 senses the lower limit of the desired self-cleaning range, for example 880° F. in the illustration, referred to as the "on" temperature (T ON). At this time the control again energizes the bake and broil elements 32, 34 in an alternate sequence with a predetermined duty cycle, for example bake on for 75 seconds and broil on for 25 seconds, as indicated by line 203. The control continues in this manner for the remainder of the active cleaning period. That is it energizes the bake and broil elements alternately with a predetermined duty cycle, as shown lines 204 and 206, from the time the sensor 84 senses the "on" temperature until the sensor next senses the "off" temperature and then deenergizes both elements 32, 34 until the sensor 84 next senses the "on" temperature, as shown by line 205. When the predetermined total time of the active self-cleaning operation is reached the control terminates all energization of elements 32, 34, for example at 3 hours in the illustration.

Also, if desired, the self-clean routine may include a default time override for ending the preheat stage. That is, if some predetermined time period (for example 30 minutes) has elapsed since the initiation of the initial preheat stage, the control will switch to the cyclical alternate energization of the bake and broil elements, even though sensor 84 has not sensed the occurrence of the trigger temperature.

It should be understood that the "trigger", "on" and "off" temperatures, as well as the cyclical duty cycles of the bake and broil element energization are all empirically determined for an individual oven design. They are inter-related and are affected by a number of factors such as, for example only, the size of the chamber 18, the composition of the liner 22, the ratings of the elements 32,34 and the applied voltage.

FIGS. 4–7 illustrate, in simplified form, the control routine for implementing this pyrolitic cleaning operation. The user selects the self-clean operation by rotation of knob 40 to the "AUTO CLEAN" position (see FIG. 2). The user can at any time interrupt the clean operation by rotating the knob to the "OFF". In addition many ovens include an "OFF" or "RESET" button which a user can push to terminate the cleaning operation.

Figure 4:
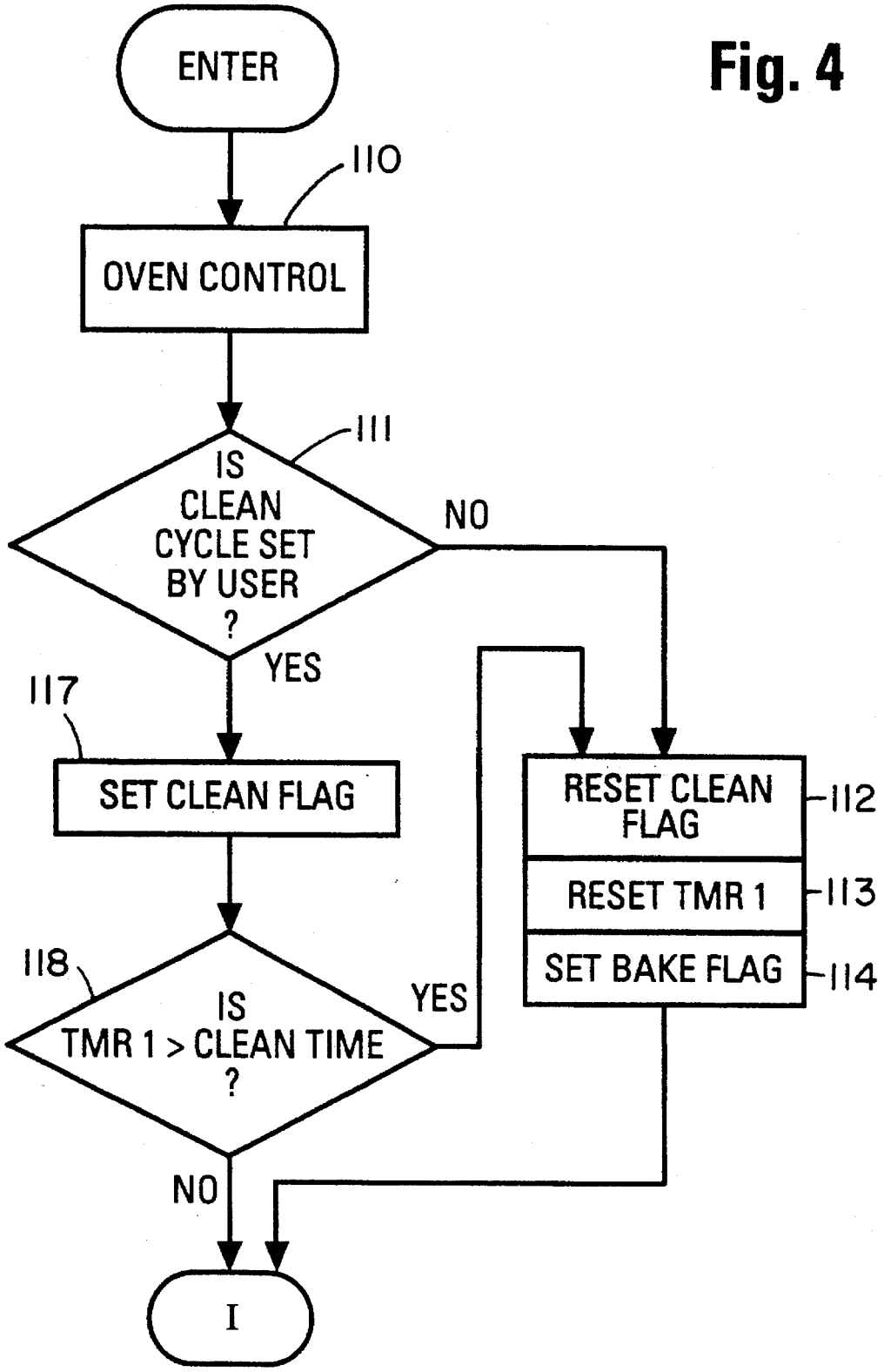
FIGS. 4–7 are simplified flow diagrams representing control sub-routines for a self cleaning operation or routine according to one embodiment of the present invention and which may be incorporated in the control program for the microprocessor in the circuit of FIG. 3.

Referring now to FIG. 4, block 110 represents the remainder of the control routine and indicates that the clean routine is a part of the overall control scheme. At inquiry 111 the control determines whether the user input, such as the position of knob 40, calls for a self cleaning operation. If NO, the control RESETS the Clean Flag at block 112, RESETS the clean operation timer (TMR 1) at block 113 and SETS the Bake Flag at block 114. The control then determines at 115 (FIG. 5) whether the Clean Flag is SET. Since that flag was just RESET at 112 the control RESETS the appropriate timers, flags and relays at 116 to place the control in its initial condition and exits the clean routine.

Returning to inquiry 111 (FIG. 4), if the user has set the control for a self-clean operation, the control SETS the Clean Flag at 117 and determines at 118 whether the time for a complete active clean operation, 3 hours in the illustration, has elapsed. If the time has elapsed, the control jumps to block 112 and exits the clean routine in the manner previously described. If the control determines at 118 that the clean time has not elapsed, the control determines at 115 whether the Clean Flag is SET. As the Clean Flag was just set at 117, the control reads the actual temperature in the oven (TS) at 119, as determined by sensor 84 (FIG. 3) which is part of probe 36 (FIG. 1). Inquiry 120 determines whether the Trigger Temperature Flag (TTF) is SET. Since this flag is SET in response to the oven temperature TS reaching the trigger temperature TT (750° F.) and the cleaning operation has just begun, the answer is No. Therefore the control proceeds to inquiry 121 and determines whether the time limit for the preheat operation (TMR2), 30 minutes in the illustration, has elapsed. Since the operation has just begun the answer is NO and the control increments the preheat timer (TMR2) at 122 and determines at 123 whether the oven temperature TS is greater than the threshold temperature TT. As the clean cycle is just beginning, the answer is NO so the control sets the Broil Relay (RL) at 124 and returns to inquiry 115.

Figure 6:
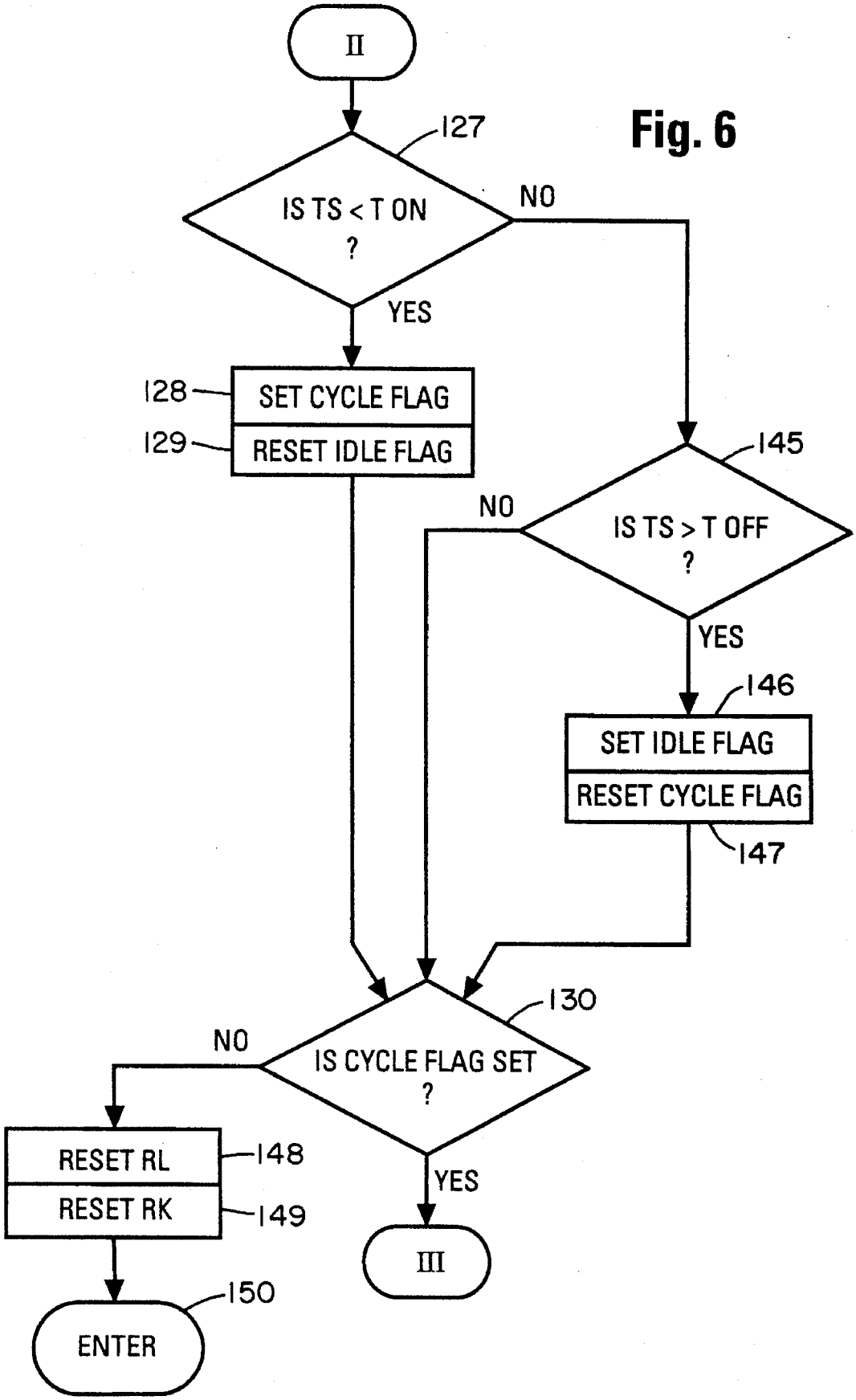

The control repeatedly runs through the loop from inquiry 115 through block 119, inquiry 120, inquiry 121, block 122, inquiry 123 and block 124 back to inquiry 115. During this time the Broil Relay RL remains SET and the broil element 34 is continuously energized to heat the oven. In normal operation the oven temperature TS eventually will exceed the trigger temperature TT. The answer at inquiry 123 then will be YES and the control will proceed to block 125. In the event the broil element has not raised the oven temperature to the trigger temperature in a predetermined default time (TMR 2 becomes greater than 30 minutes), the answer at inquiry 121 becomes YES and the control proceeds to block 125. In either event the control RESETS TMR 2 at 125 and SETS TTF at 126. This ends the preheat operation and the control proceeds to inquiry 127 (FIG. 6).

Figure 7:
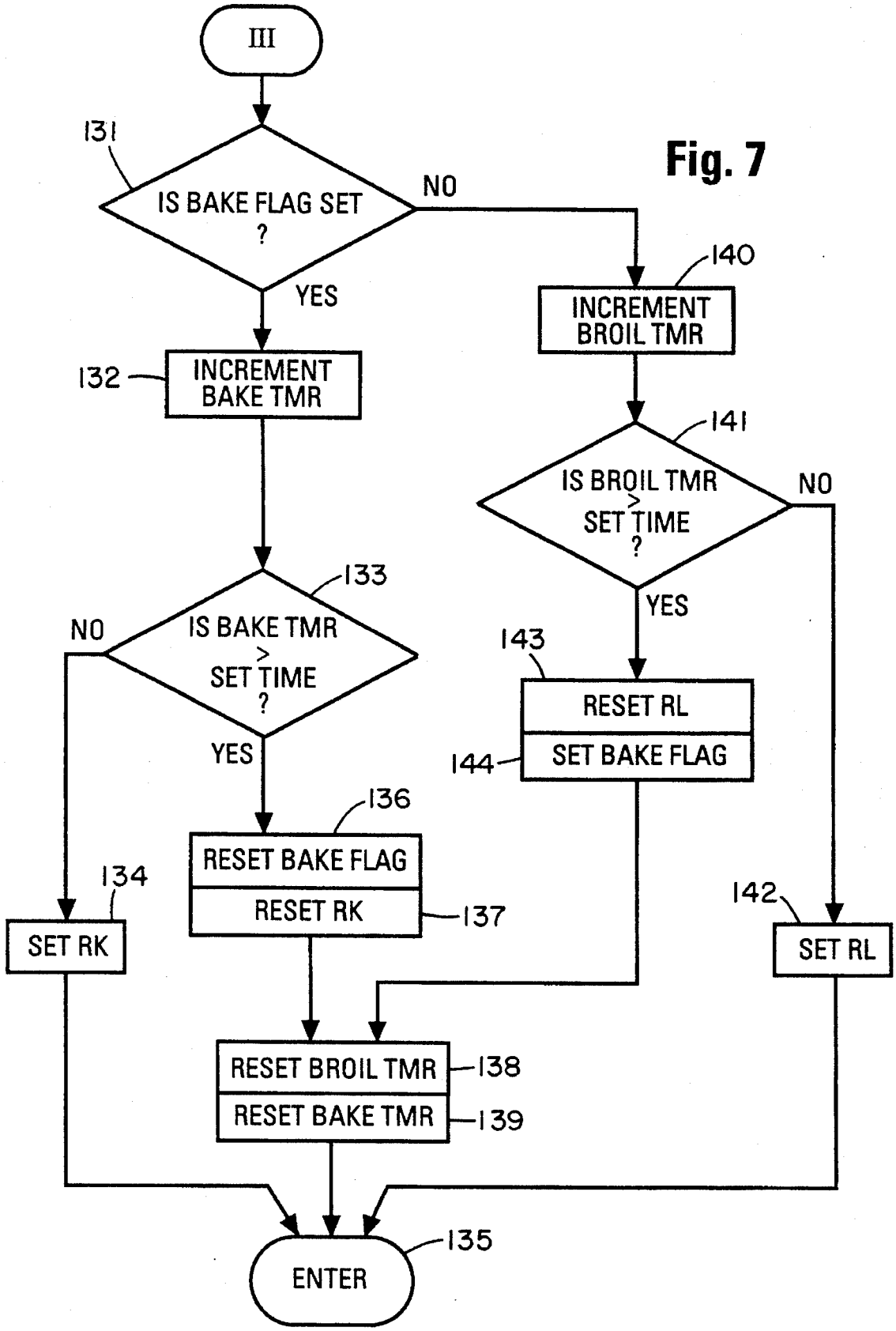

The control determines at 127 whether TS is less than the predetermined on temperature (T ON), 880° F. in the illustrative embodiment. As T ON is significantly higher then TT, initially the answer at 127 is YES and the control SETS the Cycle Flag at 128 and RESETS the Idle Flag at 129. This configures the control to cause the bake and broil units to be energized in a cyclically alternate manner with a predetermined duty cycle. (In the illustrative embodiment the duty cycle is 90 seconds of bake element energization followed by 15 seconds of broil element energization.) Then, at inquiry 130 the control determines whether the Cycle Flag is SET. Initially the answer is yes and the control proceeds to inquiry 131 (FIG. 7).

The control determines at 131 whether the Bake Flag is SET. Assuming it is SET, the control increments the Bake Timer at 132. Inquiry 133 determines whether the time accumulated by the Bake Timer is greater the predetermined time (90 seconds). Initially the answer is NO and the control SETS the Bake Relay RK at 134 and returns to the beginning of the control routine as indicated by the Enter block 135.

Normally the control repeatedly proceeds through the clean routine once every few microseconds until the Bake Timer accumulates more than 90 seconds. At the next pass through the routine, the answer at inquiry 133 (FIG. 7) is YES and the control then RESETS the Bake Flag at 136 and RESETS the Bake Relay RK at 137. This de-energizes the bake element. The control RESETS the Broil Timer at 138 and the Bake Timer at 139 and returns to the beginning of the control routine at 135.

On the next pass through the routine the control determines at 131 that the Bake Flag is not SET (it was just RESET at 136). The control increments the Broil Timer at 140. Inquiry 141 determines whether the time on the Broil Timer is greater then the predetermined time (15 seconds in the illustrative embodiment). On the initial pass the answer is NO, as the timer was just RESET at 138, so the control SETS the Broil Relay RL at block 142 and returns to the beginning of the control routine at 135.

Normally the control will repeatedly process through the clean routine once every few microseconds until the Broil Timer accumulates more than 15 seconds. At the next pass through the routine, the answer at inquiry 141 is YES and the control RESETS the Broil Relay RL at 143 and SETS the Bake Flag at 144. This de-energizes the broil element. The control then RESETS the Broil Timer at 138, RESETS the Bake Timer at 139 and returns to the beginning of the control routine at 135.

On the next pass through the routine, the control determines at 131 that the Bake Flag is SET (it was just SET at 144) and begins another 90 seconds of bake element energization, in the manner previously described. The alternate energization of the bake and broil elements with a predetermined duty cycle continues, as described above, for at least several minutes.

The preceding description assumes that the first pass through inquiry determines that the BAKE FLAG is SET. If the BAKE FLAG then is in its RESET condition, the sequence of the alternate energization of the bake and broil elements is merely shifted one step so that the broil element is initially energized. This will have no material effect on the heat generated during the overall alternate energization operation.

This operation raises the oven temperature above the trigger temperature TT and eventually the oven temperature (TS) becomes higher than the on temperature (T ON), that is 880° F. in the illustration. On the next pass through the clean routine, inquiry 127 (FIG. 6) determines that TS is not less than T ON. The control branches to inquiry 145 and determines whether Ts is greater than the OFF temperature (T OFF), that is 890° F. in the illustration. Initially TS is not greater than T OFF and the control proceeds directly to inquiry 130. Since the Cycle flag is SET, the remainder of the routine is as previously described and the duty cycle operation of the bake and broil elements continues. Eventually the oven temperature rises above the off temperature. At the next pass, inquiry 145 determines that TS is greater than T OFF. The control then SETS the Idle Flag at 146, RESETS the Cycle Flag at 147 and determines at 130 that the Cycle Flag is not SET. The control then RESETS the Broil Relay RL at 148 and RESETS the Bake Relay RK at 149, ending the cyclical energization of the bake and broil elements 32,34. The control then returns to the beginning of the control routine, as indicated at 150.

The control proceeds through the clean routine, with the heating elements 32,34 off and returns to the beginning of the routine at 150 once every few micro-seconds until the oven temperature falls to just below the on temperature. On the next pass through the routine, inquiry 127 determines that TS is less than T ON and the duty cycle operation of heating elements 32,34 begins, in the manner previously described. Thus the control operates the heating elements in a cyclically alternate manner with a predetermined duty cycle from each time the sensor 84 senses the oven temperature TS is below the on temperature (T ON) until it next senses the oven temperature is above the off temperature (T OFF) and deenergizes both heating elements from each time the sensor senses TS is higher than T OFF until it next senses TS is less than T ON. It will be understood that the speed of the control in proceeding through the entire self-clean routine is so fast as compared to the rate of change of the temperature in the oven that the control effectively operates the oven between T ON and T OFF, as sensed by sensor 84.

This clean operation continues for the predetermined "CLEAN TIME", 3 hours in the illustration. Then, on the next pass through the clean routine, inquiry 118 (FIG. 4) determines that the total time for the clean operation has elapsed and the control branches to block 112. It RESETS the Clean Flag at 112, RESETS the Clean Timer (TMR 1) at 113, Sets the Bake Flag at 114 and determines at 115 (FIG. 5) that the Clean Flag is not SET. It then resets all appropriate Timers, Flags and Relays at 116 for the oven to perform the next operation selected by an user and exits the self-clean routine at 151.

Figure 11:
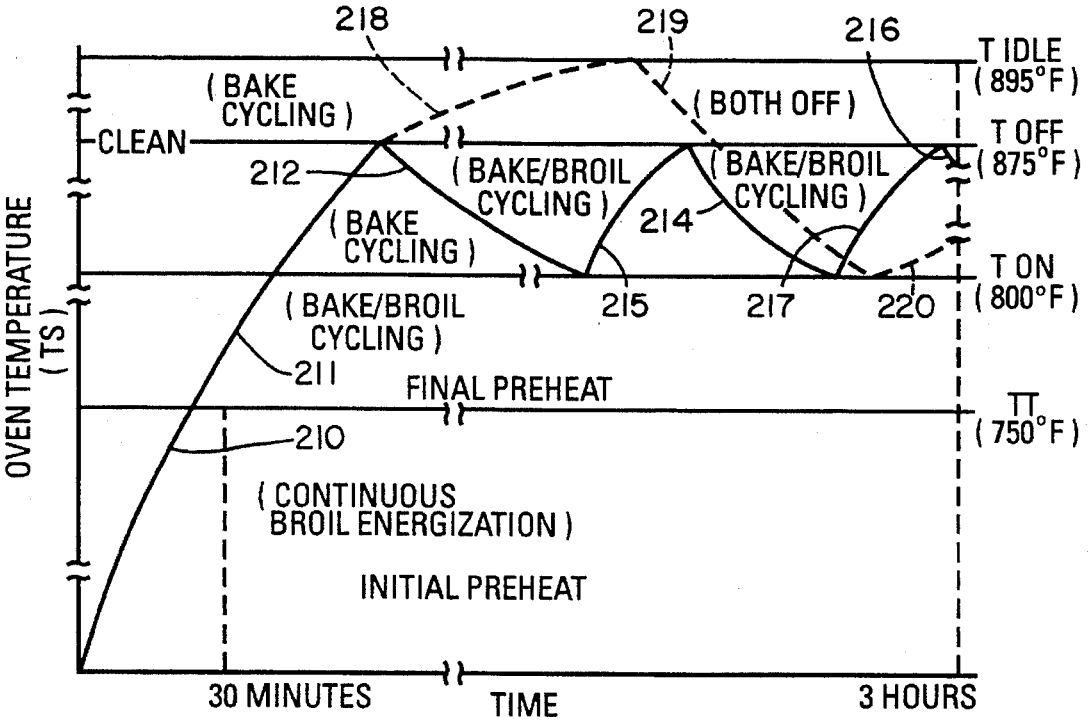
FIG. 11 is a schematic chart illustrating the temperature of the oven plotted against time in accordance with the routine of FIGS. 4, 5, 7, 8 and 9.

The exemplary control embodiment illustrated in FIGS. 4, 5, 7–9 is very similar to that of FIGS. 4–7, except for the steady state clean portion. The self-clean operation of the oven this routine is illustrated in FIG. 11. It will be understood that FIG. 11 is a schematic representation generally illustrating the operation incorporated into the routine of FIGS. 4, 5, 7–9 and that the temperature lines do not necessarily represent temperature made in a particular oven during a particular self-cleaning operation.

Referring now to FIG. 11, the broil element 34 is continuously energized until the trigger temperature TT (750° F. in the illustration) is reached, as indicated by line 210. Then the bake element and the broil element are alternately energized with a predetermined duty cycle, for example 75 seconds of bake element energization and 25 seconds broil element energization, until the off temperature (T OFF), 875° F. in the illustration, is sensed by sensor 84, see line 211. The control then energizes the bake element only with a predetermined duty cycle, for example 60 seconds on and 15 seconds off, see line 212. For the duration of the active self-clean period the bake element is energized with this duty cycle from each time the off temperature (T OFF) is sensed until the on temperature (T ON), 800° F. in the illustration, is next sensed, see lines 214 and 216. The bake and broil elements then are alternately energized with a predetermined duty cycle from each time the on temperature is sensed until the next off temperature is sensed, see lines 215 and 217.

The basic operation described above assumes that the duty cycling of the bake unit alone will either maintain the oven temperature within the desired self cleaning range or that the temperature will slowly fall to the on temperature level. However, as a precaution in the event that, for some reason, cyclical operation of the bake unit alone causes the oven temperature to rise, the control utilizes a still higher temperature setting, 895° F. in the illustration, called the idle temperature (T IDLE). In the event the temperature of the oven rises to T IDLE, see line 218, the control deenergizes both the bake and the broil elements until the sensed oven temperature falls to T ON, see line 219. The control then alternately energizes both the bake and broil elements with a predetermined duty cycle until T OFF is sensed, see line 220.

Figure 5:
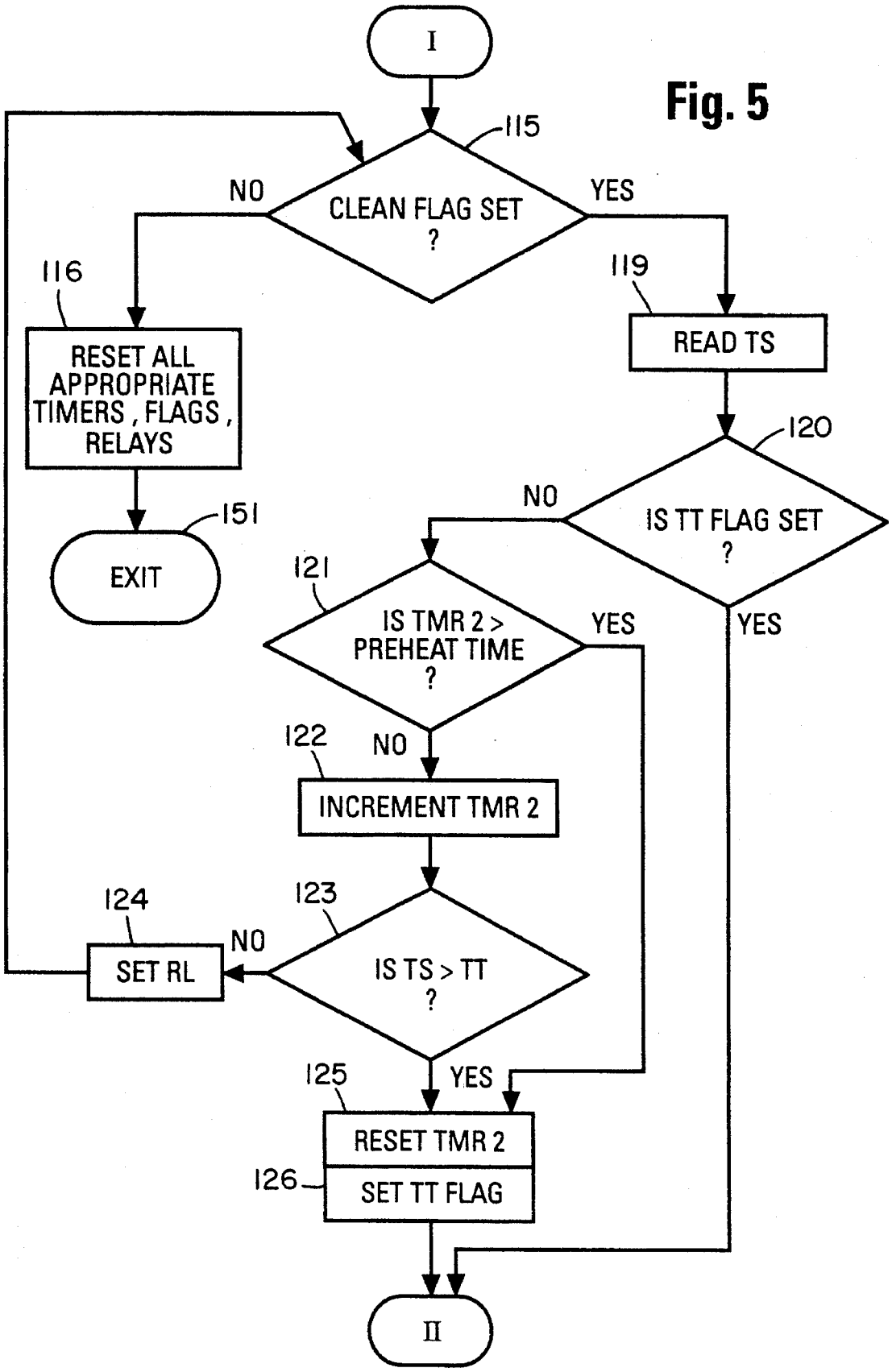

Referring now to FIGS. 4, 5 and 7–9 the control routines for implementing this self-clean operation will be described. The start-up and initial preheat routines are the same as in the embodiment of FIGS. 4–7 and, more specifically as illustrated in FIGS. 4–5 and previously described. Assuming the that the oven temperature TS has just become higher than the threshold temperature TT, the answer at 123 in FIG. 5 is Yes. The control Resets preheat timer TMR2 at 125, SETS the threshold temperature flag TTF at 126 and moves to inquiry 160 (FIG. 8) to determine whether TS is lower than T ON. Since T ON is several degrees higher than TT, the answer is YES. The control then SETS the Cycle Flag at 161, RESETS the Idle Flag at 162 and RESETS the Soak Flag at 163. The Cycle Flag, when SET, enables the bake and broil units to operate alternately with a predetermined duty cycle. The Idle Flag, when SET, deenergizes both heating elements. The Soak Flag, when SET, energizes the bake element alone with a predetermined duty cycle. The control then determines at inquiry 164 that the Cycle flag is SET and moves to the sub-routine of FIG. 7 as indicated by the III.

Figure 8:
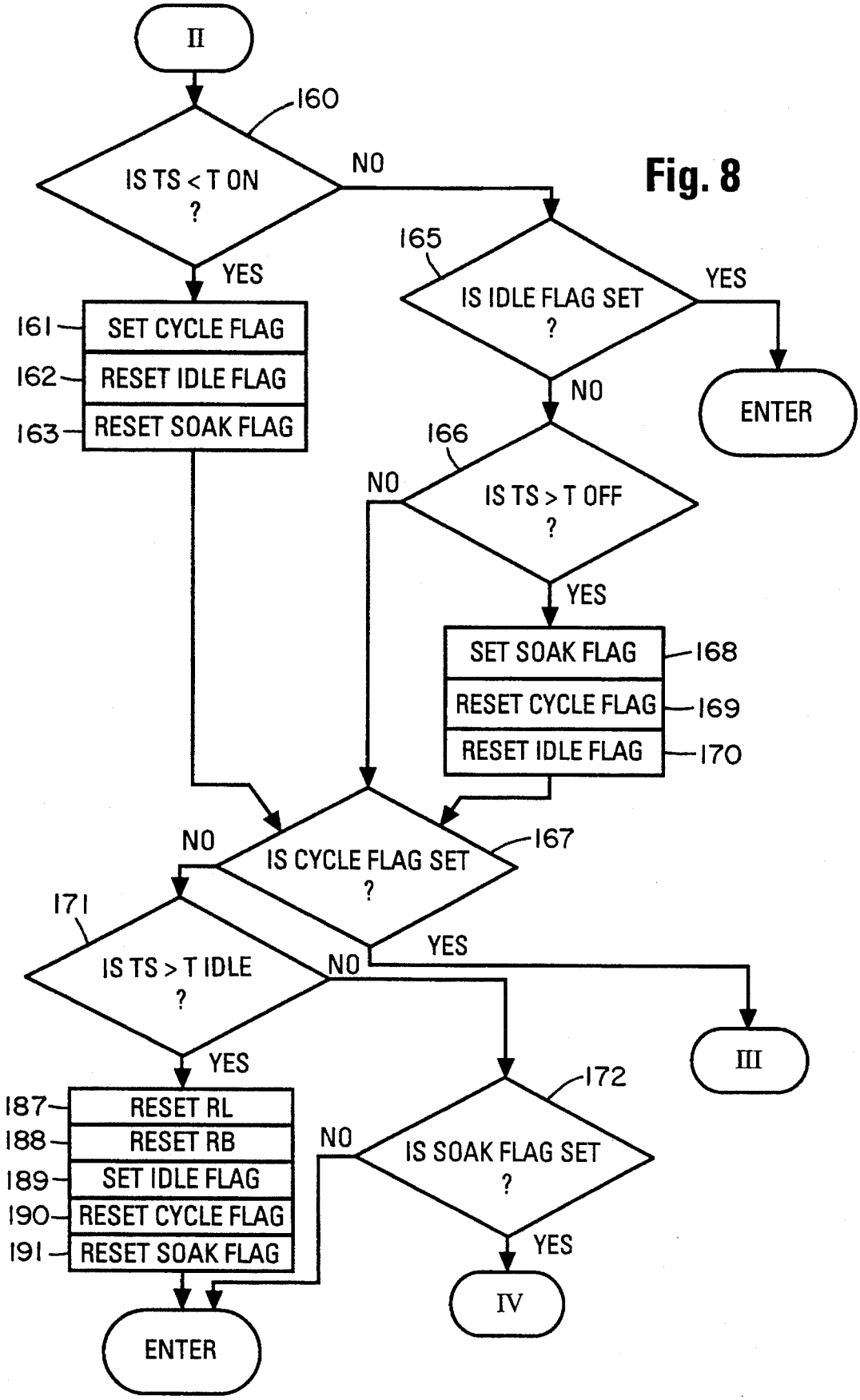
FIGS. 8 and 9 are simplified flow diagrams representing control sub-routines which, taken together with FIGS. 4, 5 and 7 represent a self cleaning oven operation sequence or routine according to another embodiment of the present invention and which may be incorporated in the control program for the microprocessor in the circuit of FIG. 3.

As previously described, FIG. 7 illustrates the sub-routine to operate the bake and broil elements in a cyclically alternate manner, for example 75 seconds of bake energization and 25 seconds of broil energization. Eventually this operation will raise the oven temperature to the on level (T ON). Referring now to FIG. 8, on the next pass control will determine at 160 that TS is not less than T ON. The control then determines at 165 that the Idle Flag is not SET (it was RESET at 162), determines at 166 that TS is not greater then T OFF ( the temperature has just passed T ON), and determines at inquiry 167 that the Cycle Flag is SET (it was SET at 161). Thus the cyclical operation of both elements continues.

Eventually the oven temperature rises above the off temperature and, at the next pass, the control determines at 166 that TS is greater than T OFF. The control then SETS the Soak Flag at 168, RESETS the Cycle Flag at 169 and RESETS the Idle Flag at 170. Since the Cycle Flag now is RESET, the control precedes from inquiry 167 to inquiry 171 and determines that TS is not greater than T IDLE, as the idle temperature is higher then the just exceeded off temperature. The control determines at 172 that the Soak Flag is SET (it was just SET at 168) and proceeds to the soak subroutine of FIG. 9.

The soak sub-routine cyclically energizes the bake element alone with a predetermined duty cycle. More specifically, the control determines at 173 whether the Bake Flag is SET. Assuming the answer is YES, the Bake Timer is incremented at 174 and inquiry 175 determines whether the Bake Timer is greater than its set time (60 seconds in the illustration). Initially the answer is NO, so the control SETS the Bake Relay at 176 and returns to the beginning of the self-clean routine. When inquiry 175 determines that the Bake Timer exceeds its SET TIME, the Bake Flag is RESET at 177, the Cycle Pause Flag is SET at 178, the Bake Relay RK is reset at 179, the Cycle Pause Timer is RESET at 180, the Bake Timer is RESET at 181 and the control returns to the beginning of the self cleaning routine. The Cycle Pause Timer (also referred to in the FIGS. as CP Timer or CP TMR) times the portion of the bake element's duty cycle during which the it is off or deenergized, for example 15 seconds in illustration.

Figure 9:
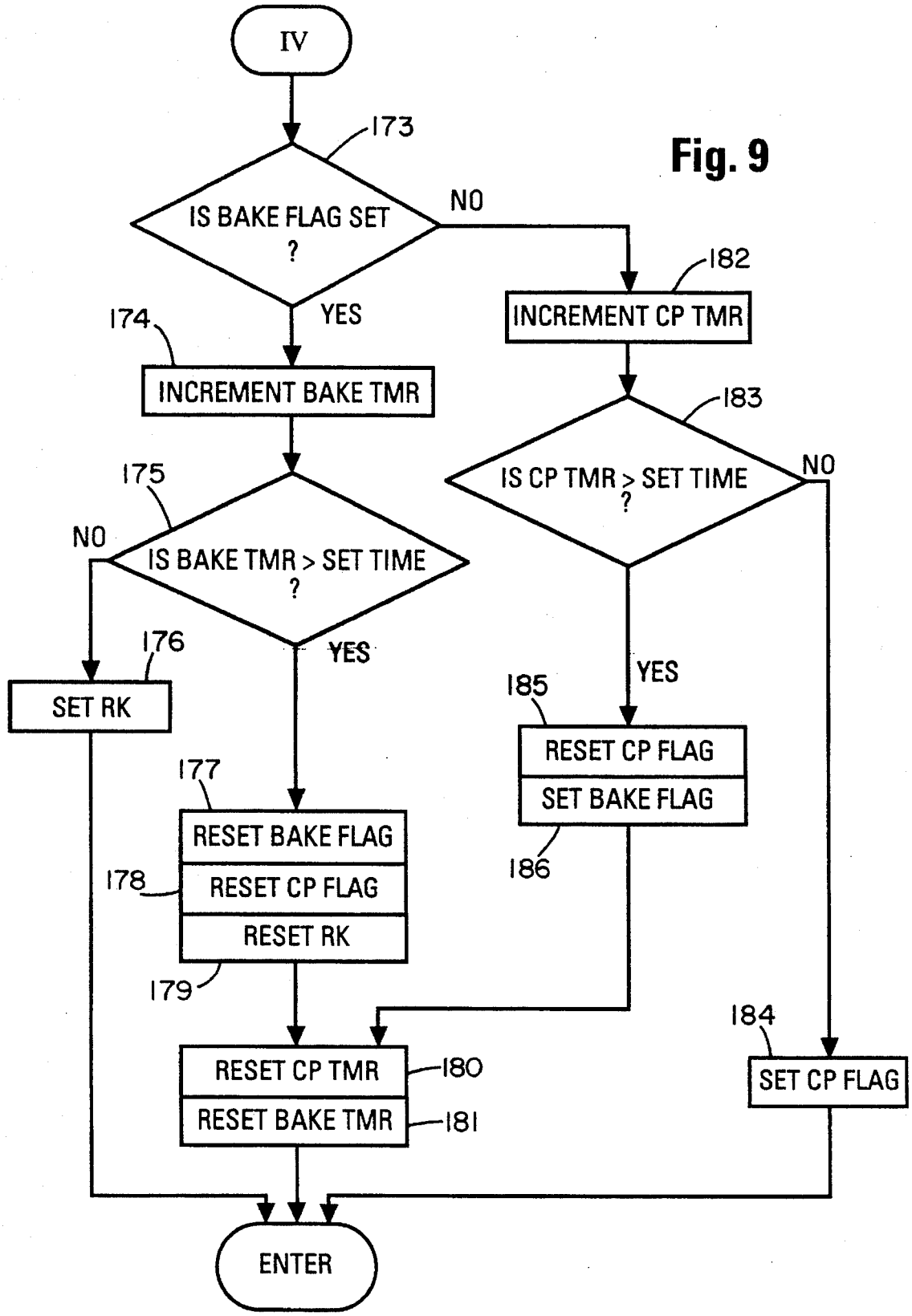

On the next pass through the Soak sub-routine of FIG. 9, control determines at 173 that the Bake Flag is not SET (it was RESET at 177) and increments the Cycle Pause Timer at 182. Initially the control determines at 183 that the Cycle Pause Timer is not greater then its SET TIME, SETS the Cycle Pause Flag at 184 and returns to the beginning of the self-clean routine. Eventually at 183 the control determines that CP TMR is greater than its SET TIME (15 seconds have passed in the illustration). Then the control RESETS the Cycle Pause Flag at 185, SETS the Bake Flag at 186, RESETS the Cycle Pause Timer at 180 and RESETS the Bake Timer 181. This configures the soak subroutine of FIG. 9 for another period of bake element energization and the control returns to the beginning of the self-clean sub-routine, as indicated by ENTER.

The soak sub-routine continues for a considerable period of time, and normally is terminated in one of three different ways. If the heat input and losses of the oven are essentially balanced, the oven temperature will remain between the on temperature and the off temperature. In that event the soak sub-routine will continue for the remainder of the self-clean operation. That is until inquiry 118 (FIG. 4) determines that the time for the overall active self cleaning operation, for example 3 hours in the illustrations, has lapsed. The control will then terminate the routine the self-clean routine in the manner described in connection with the embodiment of FIGS. 4–7.

In the event the oven looses more energy than the cyclical operation of the bake unit supplies, the oven temperature eventually will drop just below the on temperature. At the next pass through the self-clean routine, inquiry 160 will determine that TS is less than T ON and the control will institute the cyclical operation of the bake and broil elements sub-routine of FIG. 8 until inquiry 166 determines that the oven temperature TS is greater than the off temperature T OFF. At that point the control will institute another soak sub-routine of cyclical operation of the bake element alone, as illustrated in FIG. 9.

In the event that the cyclical operation of the bake unit alone provides the oven with more heat than is dissipated, the oven temperature TS will rise during the soak sub-routine operation of FIG. 9. Eventually the oven temperature will exceed the idle temperature. At the next pass through the routine, inquiry 171 (FIG. 8) will determine that TS is greater than T IDLE. Then the Broil Relay RL is SET at 187, the Bake Relay is SET at 188, the Idle Flag is SET at 189, the Cycle Flag is RESET at 190 and the Soak Flag is RESET at 191. This configures the control for a period during which the overall clean operation timer TMR 1 operates but neither the bake element nor the broil element is energized. The oven temperature will slowly fall and eventually be just below the on temperature. At the next pass through the self cleaning routine, inquiry 160 (FIG. 8) determines that TS is less than T ON and the soak sub-routine is again initiated.

It will be understood that, when inquiry 118 (FIG. 4) determines the self cleaning timer TMR 1 is greater than the CLEAN TIME, 3 hours in the illustrations, the cleaning operation is terminated in the manner described in connection with the embodiment of FIGS. 4–7, regardless of what subroutine is then in progress, and the control is configured at 116 for any subsequent operation selected by the user.

It will be understood that the self-clean routines illustrated in FIGS. 4–7 and in FIGS. 4, 5, 7–9 have been simplified for ease of understanding. Various other sub-routines may be included, as will be understood by those skilled in the art. For example, it may be desired to incorporate a short, perhaps about one second, delay between any change in the state of the relay controlling operation of one of the heating elements and a change in the operational state of the relay controlling the operation of the other heating element.

Electric ovens typically are provided with 3 or 4 wire electric power at a nominal 240 volts, which also includes availability of nominal 120 volt power. In addition, many apartment developments provide individual units with electric power at a nominal 208 volts. The particular cyclical operation chosen for an oven will depend in part on the voltage provided to the heating elements. The illustrative routines described above assumed use of the full nominal 240 volt supply for all energizations. However, use of other supply voltages will fall within the scope of this invention. For example, one may choose to cycle one element at 240 volts (or at 208 volts in an apartment) and operate the other element at another voltage, for example at 120 volts. Also one may choose to cycle one element while continuously energizing the other element. By way of example only, cyclical operation of the broil element at 240 volts may be combined with continuous operation of the bake element at 120 volts.

While the preferred embodiments described hereabove are implemented using a microprocessor; it will be understood that other means, for example relay logic controllers or mechanical timer mechanisms, can be used to implement the invention.

Gas fueled ovens also are provided with self-clean cycles and the present invention is applicable to such ovens. For example energization of a heating means, as used herein, encompasses within its meaning the operation of a corresponding gas fueled burner of a cooking oven.

While specific embodiments of the present invention have been illustrated and described herein, it is realized that modifications and changes will occur to those skilled in the art to which the invention pertains. It is therefore intended to cover all such modifications and changes as fall within the true spirit and scope of the invention.

What is claimed is:

1. A pyrolytically cleaned cooking oven having:

a liner forming a cooking chamber; a smoke eliminator having an entrance communicating with said chamber through said liner;

first heating means positioned in the portion of said chamber adjacent said smoke eliminator entrance and second heating means positioned in a portion of said chamber remote from said smoke eliminator entrance;

temperature sensing means for sensing the temperature in said chamber; and control means for providing a pyrolytic cleaning operation of said oven, said control means being connected to said first and second heating means and to said sensing means and constructed and arranged selectively to continuously energize said heating means and to energize said heating means in a cyclical mode of operation with predetermined duty cycles in which the time of energization of each heating means during each duty cycle is substantially shorter than the overall period of that cyclical mode of operation so that the heat output of the cyclically operated heating means is less than it would be with a continuous operation mode for a corresponding period of time; said control means being effective to continuously energize said first heating means until said sensing means senses a predetermined trigger temperature; to thereafter cyclically energize at least a selected one of said heating means with a predetermined duty cycle until said sensing means senses a predetermined off temperature, higher than the trigger temperature; and to thereafter deenergize both of said heating means from each time said sensing means senses the off temperature until said sensing means subsequently senses a predetermined on temperature, lower than the off temperature, and to cyclically energize at least a selected one of said heating means from each time said sensing means senses the on temperature until said sensing means subsequently senses the off temperature.

2. An oven as set forth in claim 1, wherein: said control is effective to cyclically energize one of said heating means with a first predetermined duty cycle and the other of said heating means with a second predetermined duty cycle from the time said sensing means senses said trigger temperature until said sensing means subsequently senses the off temperature.

3. An oven as set forth in claim 2, wherein: the first predetermined duty cycle includes periods of energization longer than the periods of energization of the second predetermined duty cycle.

4. An oven as set forth in claim 3, wherein: the periods of energization of said second heating means are longer than the periods of energization of said first heating means.

5. An oven as set forth in claim 1, wherein: said control includes timer means and is effective to terminate the continuous energization of said first heating means and to begin the cyclical energization of at least a selected one of said heating means at a predetermined time after initiation of continuous energization of said first heating means, even if said sensing means has not then sensed the occurrence of the trigger temperature.

6. An oven as set forth in claim 1, wherein: said control is effective to cyclically energize one of said heating means for first predetermined periods of time and the other of said heating means for second predetermined periods of time from each time said sensing means sensing the on temperature until said sensing means subsequently senses the off temperature.

7. An oven as set forth in claim 6, wherein: the predetermined periods of energization of said one of said heating means are longer than the periods of energization of said other of said heating means.

8. A pyrolytically cleaned oven as set forth in claim 7, wherein: the periods of energization of said second heating means are longer than the periods of energization of said first heating means.

9. An oven as set forth in claim 1, wherein: said control is effective to cyclically energize only a selected one of said heating means with a predetermined duty cycle from each time said sensing means senses the on temperature until said sensing means subsequently senses the off temperature.

10. An oven as set forth in claim 9, wherein: said selected one of said heating means is energized longer than it is de-energized during each duty cycle.

11. An oven as set forth in claim 9, wherein: said selected one of said heating means is said second heating means.

12. An oven as set forth in claim 1, wherein: said control includes timer means and is effective to terminate all energization of said heating means upon passage of a predetermined period of time of pyrolitic cleaning operation of said oven.

13. A pyrolytically cleaned cooking oven having:

a liner forming a cooking chamber; a smoke eliminator having an entrance communicating with the upper portion of said chamber;

broil heating means positioned adjacent the top of said chamber and bake heating means positioned remote from the top of said chamber;

temperature sensing means for sensing the temperature in said chamber; and control means for providing a pyrolytic cleaning operation of said oven, said control means being connected to said broil and bake heating means and to said sensing means and constructed and arranged selectively to continuously energize said heating means and to energize said heating means in a cyclical mode of operation with predetermined duty cycles in which the time of energization of each heating means during each duty cycle is substantially shorter than the overall period of that cyclical mode of operation so that the heat output of the cyclically operated heating means is less than it would be with a continuous operation mode for a corresponding period of time; said control means being effective to continuously energize said broil heating means until said sensing means senses a predetermined trigger temperature; to thereafter cyclically energize only said broil heating means with one predetermined duty cycle and only said bake heating means with another predetermined duty cycle until said sensing means senses a predetermined off temperature, higher than the trigger temperature; and to thereafter deenergize both of said heating means from each time said sensing means senses the off temperature until said sensing means subsequently senses a predetermined on temperature, lower than the off temperature, and to cyclically energize said broil heating means with one predetermined duty and said bake heating means with another predetermined duty cycle from each time said sensing means senses the predetermined on temperature until said sensing means subsequently senses the predetermined off temperature.

14. An oven as set forth in claim 13, wherein: each duty cycle of energization said broil heating means is the reciprocal of the corresponding duty cycle of energization of said bake heating means so that only one of said broil and bake heating means is energized at a time during cyclical operation of said heating means.

15. An oven as set forth in claim 14, wherein: the predetermined periods of cyclical energization of said bake heating means are longer than said predetermined periods of cyclical energization of said broil heating means.

16. An oven as set forth in claim 13, wherein: said control includes timer means and is effective to terminate the continuous energization of said broil heating means and to begin the cyclical energization of said broil and bake heating means at a predetermined time after initiation of continuous energization of said broil heating means, even if said sensing means has not then sensed the occurrence of the trigger temperature.

17. An oven as set forth in claim 13, wherein: said control includes timer means and is effective to terminate all energization of said heating means upon passage of a predetermined period of time of pyrolitic cleaning operation of said oven.

18. A pyrolytically cleaned cooking oven having:

a liner forming a cooking chamber; a smoke eliminator having an entrance communicating with the upper portion of said chamber;

broil heating means positioned adjacent the top of said chamber and bake heating means positioned remote from the top of said chamber;

temperature sensing means for sensing the temperature in said chamber; and control means for providing a pyrolytic cleaning operation of said oven, said control means being connected to said broil and bake heating means and to said sensing means and constructed and arranged selectively to continuously energize said heating means and to energize said heating means in a cyclical mode of operation with predetermined duty cycles in which the time of energization of each heating means during each duty cycle is substantially shorter than the overall period of that cyclical mode of operation so that the heat output of the cyclically operated heating means is less than it would be with a continuous operation mode for a corresponding period of time; said control means being effective to continuously energize said broil heating means until said sensing means senses a predetermined trigger temperature; to thereafter cyclically energize said broil heating means with a first predetermined duty cycle and cyclically energize said bake heating means with a second predetermined duty cycle until said sensing means senses a predetermined off temperature, higher than the trigger temperature; and to thereafter cyclically energize only said bake heating means from each time said sensing means senses the off temperature until said sensing means subsequently senses a predetermined on temperature, lower than the off temperature, and to cyclically energize said broil heating means with one predetermined duty and cyclically energize said bake heating means with another predetermined duty cycle from each time said sensing means senses the predetermined on temperature until said sensing means subsequently senses the predetermined off temperature.

19. An oven as set forth in claim 18, wherein: the first and second duty cycles are reciprocal so that said broil and bake heating means are alternately energized during cyclical operation of said heating means.

20. An oven as set forth in claim 19, wherein: the predetermined periods of cyclical energization of said bake heating means are longer than the predetermined periods of cyclical energization of said broil heating means during the time between said sensing means sensing the trigger temperature and said sensing means subsequently sensing the off temperature.

21. An oven as set forth in claim 19, wherein: the predetermined periods of cyclical energization of said bake heating means are longer than the predetermined periods of energization of said broil heating means during the time between said sensing means sensing the on temperature and said sensing means subsequently sensing the off temperature.

22. An oven as set forth in claim 18, wherein: said control includes timer means and is effective to terminate the continuous energization of said broil heating means and to begin the cyclical energization of said broil and bake heating means at a predetermined time after initiation of continuous energization of said broil heating means, even if said sensing means has not then sensed the occurrence of the trigger temperature.

23. An oven as set forth in claim 18, wherein: said control includes timer means and is effective to terminate all energization of said heating means upon passage of a predetermined period of time of pyrolitic cleaning operation of said oven.

24. A pyrolytically cleaned cooking oven having:

a liner forming a cooking chamber; a smoke eliminator having an entrance communicating with said chamber;

first heating means positioned in said chamber adjacent said smoke eliminator entrance and second heating means positioned in said chamber remote from said smoke eliminator entrance;

temperature sensing means for sensing the temperature in said chamber; and control means for providing a pyrolytic cleaning operation of said oven, said control means being connected to said first and second heating means and to said sensing means and constructed and arranged selectively to continuously energize said heating means and to energize said heating means in a cyclical mode of operation with predetermined duty cycles in which the time of energization of each heating means during each duty cycle is substantially shorter than the overall period of that cyclical mode of operation so that the heat output of the cyclically operated heating means is less than it would be with a continuous operation mode for a corresponding period of time; said control means being effective to continuously energize said first heating means until said sensing means senses a predetermined trigger temperature; to thereafter cyclically energize at least a selected one of said heating means with a predetermined duty cycle until said sensing means senses a predetermined off temperature, higher than the trigger temperature; and to thereafter selectively energize at least one of said first and second heating means in a predetermined manner to maintain the temperature sensed by said sensing means between the off temperature and an on temperature, lower than the off temperature.

25. An oven as set forth in claim 24, wherein:

said control means is effective to deenergize said at least one selected heating means upon said sensing means sensing the off temperature and to energize said at least one selected heating means with a predetermined duty cycle upon said sensing means sensing the on temperature.

26. An oven as set forth in claim 25, wherein:

said first and second heating means are electrically energized and said oven includes means for supplying electric energy at a first voltage level and at a second voltage level, lower than said first level;

said control means being effective to energize one of said heating means at the first voltage level and to energize the other of said heating means at the second voltage level.

27. An oven as set forth in claim 26, wherein;

said control means is effective to cyclically energize said one of said heating means with a predetermined duty cycle at the first voltage level and to energize said other of said heating means in a predetermined manner at the second voltage level upon said sensing means sensing the on temperature and to deenergize at least said one of said heating means upon said sensing means sensing the off temperature.

28. An oven as set forth in claim 27, wherein: said control means is effective to also deenergize said other of said heating means upon said sensing means sensing the off temperature.

29. An oven as set forth in claim 27, wherein: said control means is effective to continuously energize said other of said heating means upon said sensing means sensing said on temperature.

30. An oven as set forth in claim 27, wherein: said control means is effective to energize said other of said heating means with a predetermined duty cycle upon said sensing means sensing the on temperature.

* * * * *